US008164408B2

(12) United States Patent
Kim

(10) Patent No.: US 8,164,408 B2
(45) Date of Patent: Apr. 24, 2012

(54) PLANAR TRANSFORMER

(75) Inventor: Chong Eun Kim, Daejeon (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 0 days.

(21) Appl. No.: 12/640,133

(22) Filed: Dec. 17, 2009

(65) Prior Publication Data

US 2011/0050379 A1 Mar. 3, 2011

(30) Foreign Application Priority Data

Sep. 2, 2009 (KR) ..... 10-2009-0082423

(51) Int. Cl.
*H01F 5/00* (2006.01)
*H01F 27/28* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 5,175,525 A * 12/1992 Smith ..... 336/83
5,781,093 A 7/1998 Grandmont et al.
6,636,140 B2 * 10/2003 Fujiyoshi et al. ..... 336/200
6,831,544 B2 12/2004 Patel et al.
6,876,555 B2 * 4/2005 Matsumoto et al. ..... 361/782
2002/0159214 A1 10/2002 Perlick et al.
2004/0032313 A1 * 2/2004 Ferencz et al. ..... 336/200
2004/0113739 A1 * 6/2004 Du et al. ..... 336/200

OTHER PUBLICATIONS

Korean Office Action for Application No. 10-2009-008423 issued Apr. 9, 2011.

* cited by examiner

*Primary Examiner* — Anh Mai
*Assistant Examiner* — Ronald Hinson
(74) *Attorney, Agent, or Firm* — Lowe, Hauptman, Ham & Berner, LLP

(57) ABSTRACT

There is provided a planar transformer having a dual-bobbin structure. The planar transformer includes a core unit including a pair of cores that are electromagnetically coupled to each other, and a bobbin unit including an inner bobbin part and a board part. The inner bobbin part includes a bobbin body having a predetermined volume and having a through hole into which the core is inserted, and a first winding wound around an outer circumferential surface of the bobbin body, and the board part includes at least one board including a board body having a predetermined surface area and having a through hole into which the inner bobbin part and the core are inserted, and a second winding formed on at least one surface of the board body and causing electromagnetic action with the first winding.

6 Claims, 8 Drawing Sheets

PLANAR TRANSFORMER

CROSS-REFERENCE TO RELATED APPLICATIONS

This application claims the priority of Korean Patent Application No. 10-2009-0082423 filed on Sep. 2, 2009, in the Korean Intellectual Property Office, the disclosure of which is incorporated herein by reference.

BACKGROUND OF THE INVENTION

1. Field of the Invention

The present invention relates to a planar transformer, and more particularly, to a planar transformer having a dual-bobbin structure.

2. Description of the Related Art

Recently, power supply units have been required to be slimmer due to the trend towards slimmer electronic devices.

Even if power supply units can have slim profiles by driving power terminals at high frequencies, the slimming of power supply units is limited by magnetic devices and capacitors contained therein.

Slimmer capacitors with heights and diameters small enough for slim power supply units have been recently developed, whereas there has been not much progress in the slimming of magnetic devices.

As for inductors and transformers, which are representative components of magnetic devices, a multilayer board having a printed circuit is stacked to thereby implement a winding of a magnetic device. In this way, magnetic devices can be slimmed; however, this process increases the manufacturing cost of the multilayer board.

Furthermore, the greater the number of turns (winding), the thicker the multilayer board becomes, adversely affecting the slimming of devices.

SUMMARY OF THE INVENTION

An aspect of the present invention provides a planar transformer having a dual bobbin structure.

According to an aspect of the present invention, there is provided a planar transformer including: a core unit including a pair of cores that are electromagnetically coupled to each other; and a bobbin unit including: an inner bobbin part including a bobbin body having a predetermined volume and having a through hole into which the core is inserted, and a first winding wound around an outer circumferential surface of the bobbin body; and a board part including at least one board including a board body having a predetermined surface area and having a through hole into which the inner bobbin part and the core are inserted, and a second winding formed on at least one surface of the board body and causing electromagnetic action with the first winding.

The board part may include a plurality of boards that are stacked.

The first winding may have a greater number of turns than the second winding.

The pair of cores may have first to third legs that are electromagnetically coupled.

The board may further include two side through holes, the first leg may be inserted into the through hole of the inner bobbin part and the through hole of the board, and the second and third legs may be inserted into the side through holes, respectively.

According to another aspect of the present invention, there is provided a planar transformer including: a core unit including a pair of cores that are electromagnetically coupled to each other; and a bobbin unit including: an inner bobbin part including a bobbin body having a predetermined volume and having a through hole into which the core is inserted, and a first winding wound around an outer circumferential surface of the bobbin body; and a board part including at least one board including a board body having a predetermined surface area and having a through hole into which the core is inserted, and a second winding formed on at least one surface of the board body and causing electromagnetic action with the first winding, wherein the board part and the inner bobbin part are stacked.

The plurality of boards may be stacked on the inner bobbin part. Alternatively, the inner bobbin part may be stacked between the plurality of boards.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
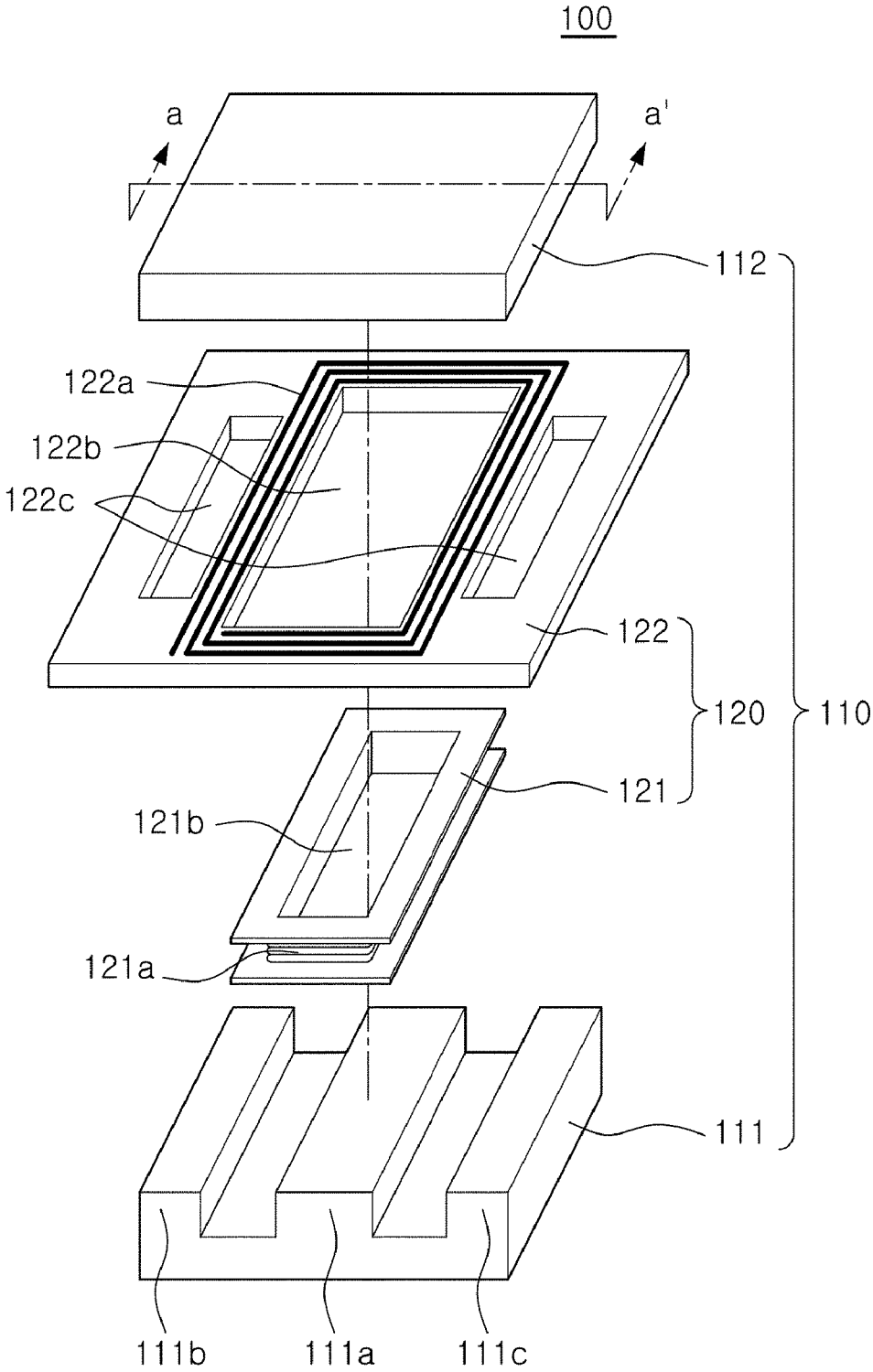
FIG. 1 is an exploded perspective view of a first exemplary embodiment of the present invention.

FIG. 1 is an exploded perspective view of a first exemplary embodiment of the present invention.

Referring to FIG. 1, a planar transformer 100, according to the first exemplary embodiment of the present invention, includes a core unit 110 and a bobbin unit 120.

The core unit 110 may include a pair of cores 111 and 112, and the pair of cores 111 and 112 have first to third legs 111*a*, 111*b* and 111*c* and are electromagnetically coupled together through the first to third legs 111*a*, 111*b* and 111*c*. The pair of cores 111 and 112 may realize an EI core or an EE core having first to third legs 111*a*, 111*b* and 111*c*. Even if only an EI core is illustrated in FIG. 1, the coupled shape of cores is the same between the EI core and the EE core. Therefore, the EE core, even if not illustrated, is considered to be naturally inferable from the EI core. In addition, various types of cores such as EER, PQ and DS cores may be employed for the present invention.

The bobbin unit 120 may include an inner bobbin part 121 and a board part including at least one board 122.

The inner bobbin part 121 includes a bobbin body having a predetermined volume, and the bobbin body may have a through hole 121*b* in which the first leg 111*a* of the core inner bobbin part 121 of the core unit 110 is inserted. A first winding 121*a* is wound around the outer circumferential surface of the bobbin body. Thus, the first winding 121*a* may be wound perpendicularly to the longitudinal direction of the first leg 111*a*.

The board part may include at least one board 122, and the board 122 may be a monolayer or multilayer printed circuit board (PCB). The board 122 has a through hole 122*b* in which the inner bobbin part 121 may be inserted along with the first leg 111*a* of the core unit 110. In addition, the board 122 may further include side through holes 122*c* in which the second and third legs 111*b* and 111*c* may be inserted, respectively.

A second winding 122*a* may be printed on one surface of the board 122 along the circumference of the board 122. The second winding 122*a* may be printed around the through hole 122*b* in the form of a conductive pattern. The second winding 122*a* performs a voltage conversion function of the transformer through electromagnetic action with the first winding 121*a*. The first winding 121*a* and the second winding 122*a* may each have a preset number of turns. Considering the height of the transformer, the number of turns of the first winding 121*a* may be greater than the number of turns of the second winding 122*a*.

For example, the first winding 121*a* may serve as a primary winding of power conversion and the second winding 122*a* may serve as a secondary winding. Considering that the number of turns of a primary winding is generally greater than the number of turns of a secondary winding, the first winding 121*a* may be formed around the outer circumferential surface of the inner bobbin part 121 having a relatively large winding area. Also, considering that the level of current flowing in a secondary winding is higher than that of current flowing in a primary winding, the secondary winding needs to have a relatively small number of turns while having a thickness or width large enough to allow current to flow with a high level. Therefore, the second winding 122*a* may be printed on the board 122 having a wide surface area.

The inner bobbin part 121 is inserted into the through hole 122*b* of the board 122, thereby achieving a reduction in the volume of a transformer.

Figure 2:
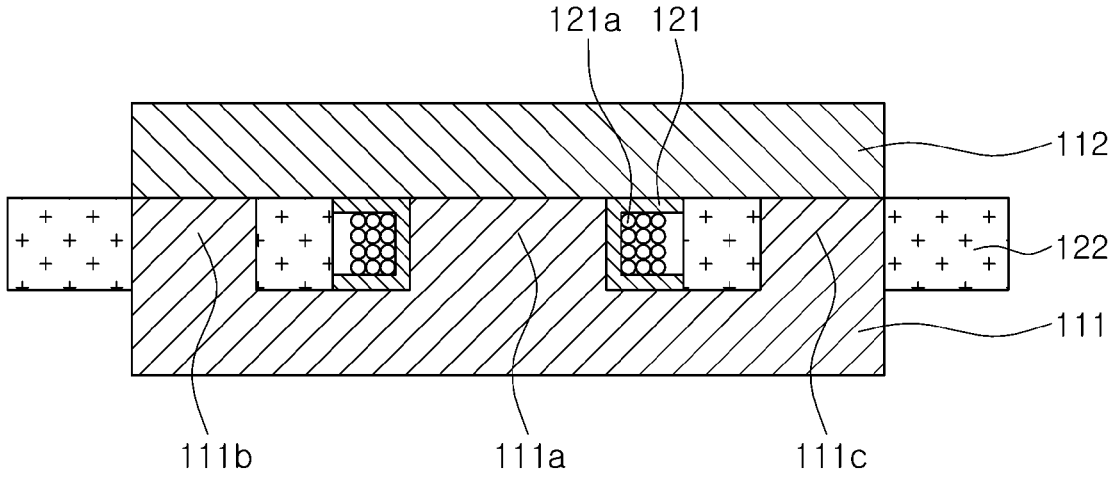
FIG. 2 is a cross-sectional view taken along line a-a' of the first exemplary embodiment of the present invention.

FIG. 2 is a cross-sectional taken along line a-a' of FIG. 1.

Referring to FIG. 2 as well as FIG. 1, the pair of cores 111 and 112 of the core unit 110 are electromagnetically coupled through the first to third legs 111*a*, 111*b* and 111*c*, and the inner bobbin part 121 and the board 122 are disposed between the pair of cores 111 and 1112. Here, the first leg 111*a* is inserted into the through hole 121*b* of the inner bobbin part 121, the inner bobbin part 121 is inserted into the through hole 122*b* of the board 122, and the second and third legs 111*b* and 111*c* are respectively inserted into the side through holes 122*c* of the board 122.

Accordingly, the inner bobbin part 121, around which the first winding 121*a* with a greater number of turns than the second winding 122*a* is wound, is inserted into the through hole 122*b* of the board 122, thereby achieving a reduction in the height and volume of the transformer.

Figure 3:
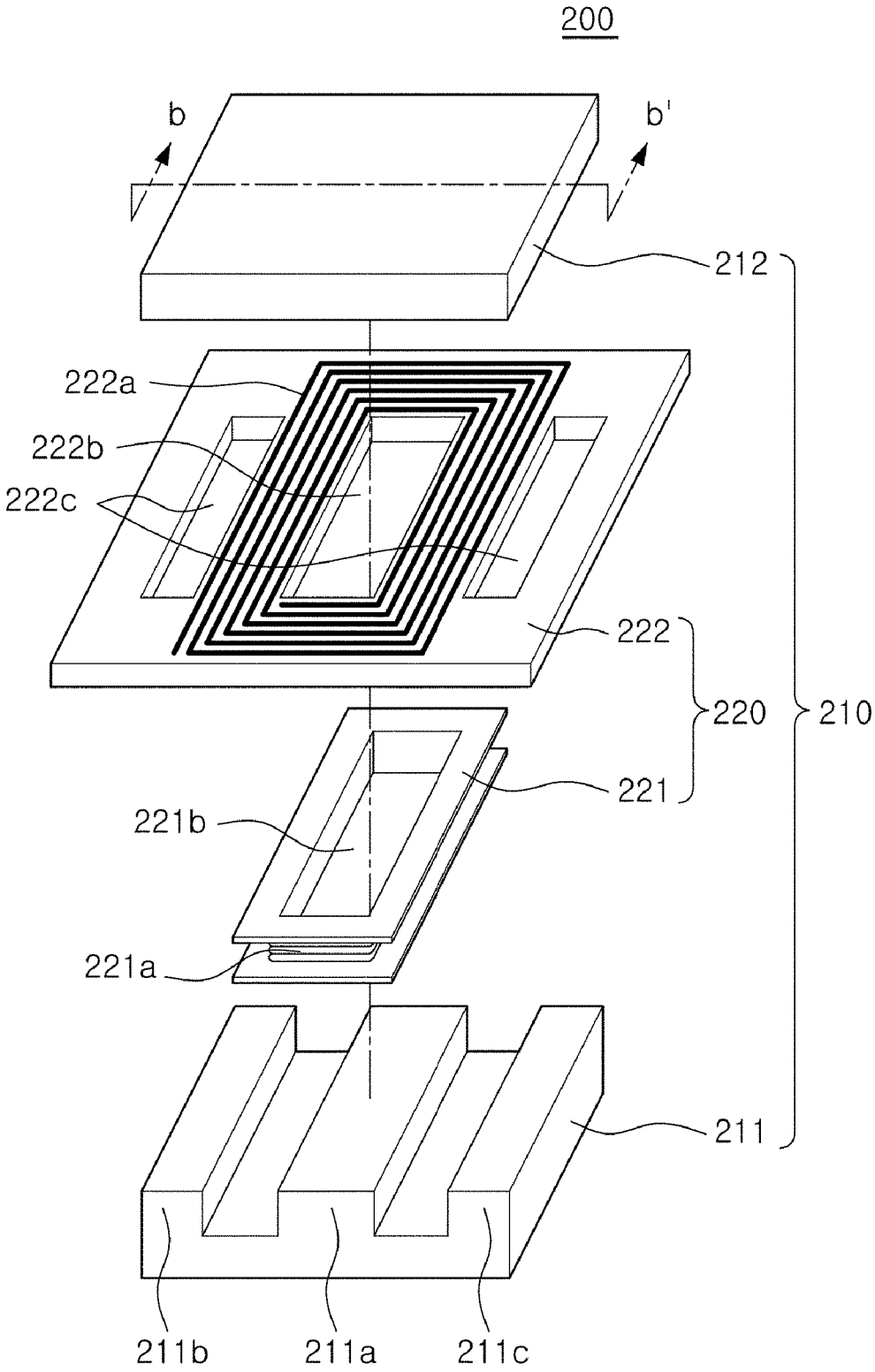
FIG. 3 is an exploded perspective view of a second exemplary embodiment of the present invention.

FIG. 3 is an exploded perspective view of a second exemplary embodiment of the present invention.

Referring to FIG. 3, a planar transformer 200 of the second exemplary embodiment is different from the planar transformer 100 of FIG. 1, in that an inner bobbin part 221 and a board 222 are stacked.

Similarly to the planar transformer 100 of FIG. 1, the planar transformer depicted in FIG. 3 includes a core unit 210 including a pair of cores 211 and 212 having first to third legs 211*a*, 211*b* and 211*c*, and a bobbin unit 220 including an inner bobbin part 221 having a through hole 221*a*, and a board part including at least one board 222 having a through hole 222*b* and side through holes 222*c*. A first winding 221*a* is wound around the outer circumferential surface of the bobbin body of the inner bobbing part 221, and a second winding 222*a* is printed on one surface of the board 222. To acquire desired electrical characteristics, the second winding 222*a* may have a greater number of turns than the second winding 122*a* of the planar transformer 100 depicted in FIG. 1. Thus, the through hole 222*b* may be reduced in size to ensure the presence of a required surface area for the winding, and thus the board 222 may be stacked on the inner bobbin part 221.

Figure 4:
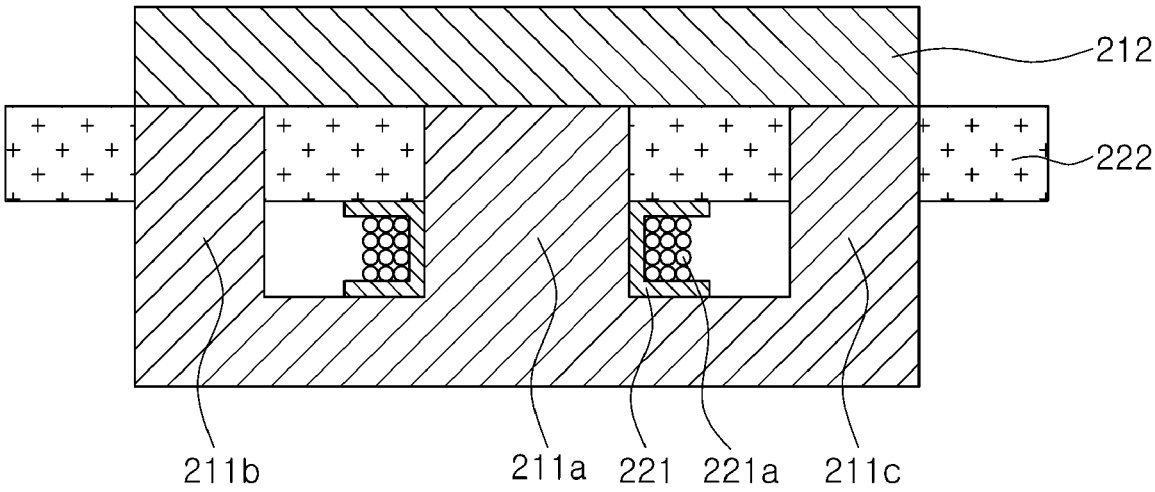
FIG. 4 is a cross-sectional view taken along line a-a' of the second exemplary embodiment of the present invention.

FIG. 4 is a cross-sectional view taken along line b-b' of FIG. 3.

Referring to FIGS. 3 and 4, the board 222 may be stacked on the inner bobbin part 221.

Accordingly, when the second winding 222*a* needs to have a wide winding area, the number of turns of the second winding 222*a* is increased by reducing the size of the through hole 222*b* of the board 222, and the board 222 may be then stacked on the inner bobbin part 221. The planar transformer 200 of this embodiment may have a greater volume than the planar transformer 100 depicted in FIGS. 1 and 2. However, considering that a plurality of boards need to be stacked when the number of turns of the first winding and the number of turns of the second winding are satisfied only by stacking a plurality of boards, the planar transformer 200 of this embodiment may achieve a reduction in height and volume, as compared to the related art transformer in which a plurality of boards are stacked.

Figure 5:
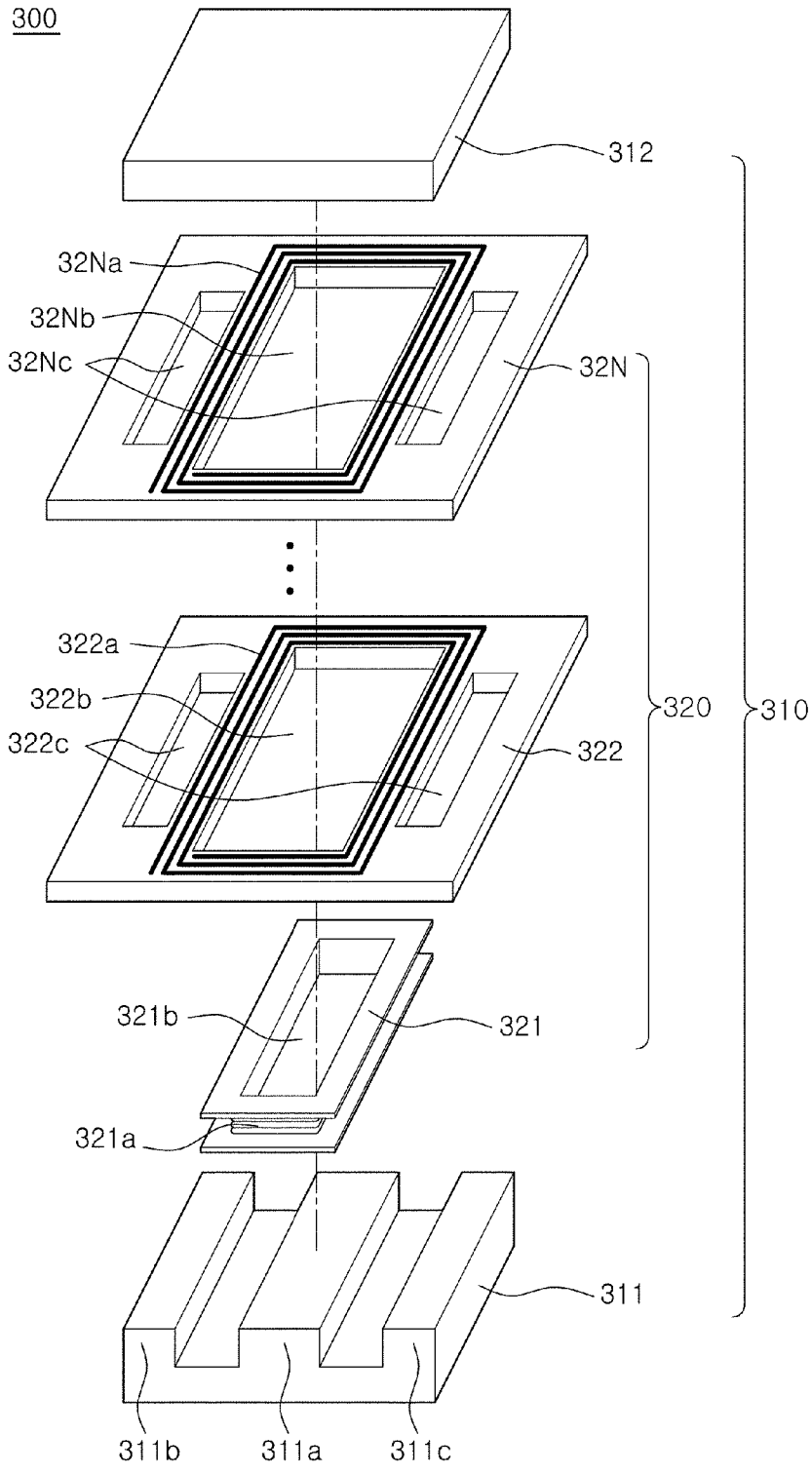
FIG. 5 is an exploded perspective view of a third exemplary embodiment of the present invention.

FIG. 5 is an exploded perspective view of a third exemplary embodiment of the present invention.

According to the third exemplary embodiment, the planar transformer 100 depicted in FIGS. 1 and 2 may be provided with a plurality of boards.

Similarly to the planar transformer 100 depicted in FIG. 1, a planar transformer 300 of the third exemplary embodiment includes a core unit 310 including a pair of cores 311 and 312 having first to third legs 311*a*, 311*b* and 311*c*, a bobbin unit 320 including an inner bobbin part 321 having a through hole 321*a*, and a board part including a board 322 having a through hole 322*b* and side through holes 322*c*. A first winding 321*a* is wound around the outer circumferential surface of the bobbin body of the inner bobbin part 321, and a second winding 322*a* is printed on one surface of the board 322.

The board part may include a plurality of boards 322 to 32N when the second winding 322*a* needs to have a large number of turns exceeding the winding formation capacity of a single board, or when a plurality of second windings need to output power having respective different voltage levels through electromagnetic action with the first winding 321*a*. In this case, the plurality of boards 322 to 32N may be stacked. Second windings 322*a* to 32Na may be printed on the plurality of boards 322 to 32N, respectively. The inner bobbin part 321 is inserted into the through holes 322*b* to 32Nb of the plurality of boards 322 to 32N, so that the pair of cores 311 and 312 can be electromagnetically coupled together through the first leg 311*a*. Likewise, the second and third legs 311*b* and 311*b* are inserted into the side through holes 322*c* to 32Nc of the plurality of boards 322 to 32N, so that the pair of cores 311 and 312 can be electromagnetically coupled to each other. Here, the plurality of second windings 322*a* to 32Na respectively provided on the plurality of boards 322 to 32N may output power having respective preset voltage levels, or may be electrically connected to output power of a single voltage level.

As described above, according to this embodiment, even if a plurality of boards are stacked to cope with the case that the second winding needs to have a large number of turns or to output multiple outputs, the height of the transformer is reduced by inserting the inner bobbin part provided with the first winding into the through hole. Accordingly, the transformer may achieve a reduction in volume (slimming).

Figure 6:
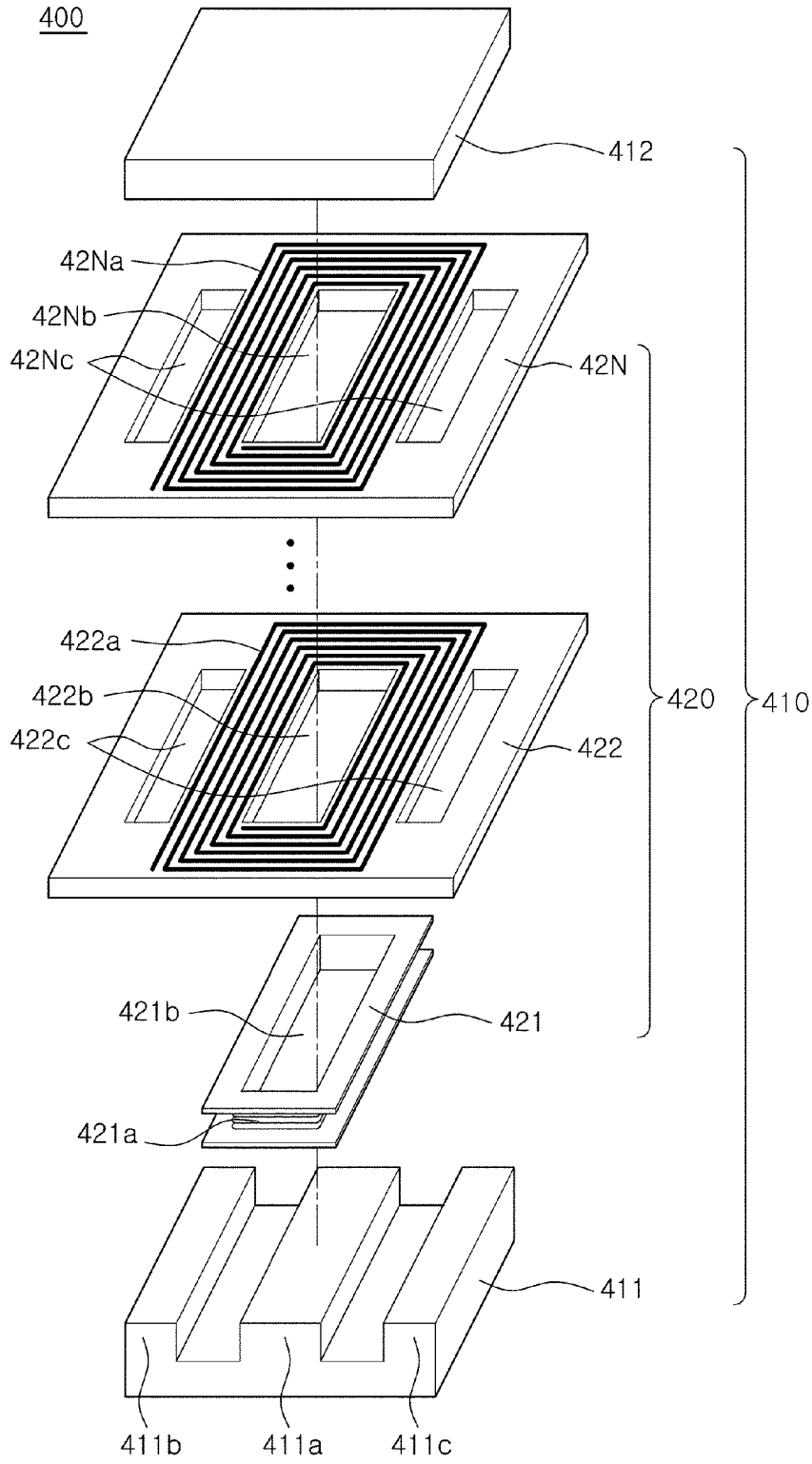
FIG. 6 is an exploded perspective view of a fourth exemplary embodiment of the present invention.

FIG. 6 is an exploded perspective view of a fourth exemplary embodiment of the present invention.

According to the fourth exemplary embodiment, a plurality of boards are provided in the planar transformer 200 depicted in FIGS. 3 and 4.

Similarly to the planar transformer 200 of FIG. 3, a planar transformer 400, according to this embodiment, includes a core unit 410 including a pair of cores 411 and 412 having first to third legs 411*a*, 411*b* and 411*c*, and a bobbin unit 420 including an inner bobbin part 421 having a through hole 421, and a board part having a board 422 including a through hole 422*b* and side through holes 422*c*. A first winding 421*a* is wound around the outer circumferential surface of the bobbin body of the inner bobbin part 421, and a second winding 422*a* is printed on one surface of the board 422.

The board part may include a plurality of boards 422 to 42N when the second winding 422*a* needs to have a large number of turns exceeding the winding formation capacity of a single board, or when a plurality of second windings need to output power having respective different voltage levels through electromagnetic action with the first winding 421*a*. In this case, the plurality of boards 422 to 42N may be stacked. Second windings 422*a* to 42Na may be printed on the plurality of boards 422 to 42N, respectively. The first leg 411*a* is inserted into the respective through holes 422*b* to 42Nb of the plurality of boards 422 to 42N, so that the pair of cores 411 and 412 can be electromagnetically coupled. Likewise, the second and third legs 411*b* and 411*b* are inserted into the side through holes 422*c* to 42Nc of the plurality of boards 422 to 42N, so that the pair of cores 411 and 412 can be electromagnetically coupled. Here, the plurality of second windings 422*a* to 42Na, provided on the plurality of boards 422 to 42N respectively, may output power having respective preset voltage levels, or may be electrically connected to output power of a single voltage level. The plurality of boards 422 to 42N may be stacked on the inner bobbin part 421.

Figure 7:
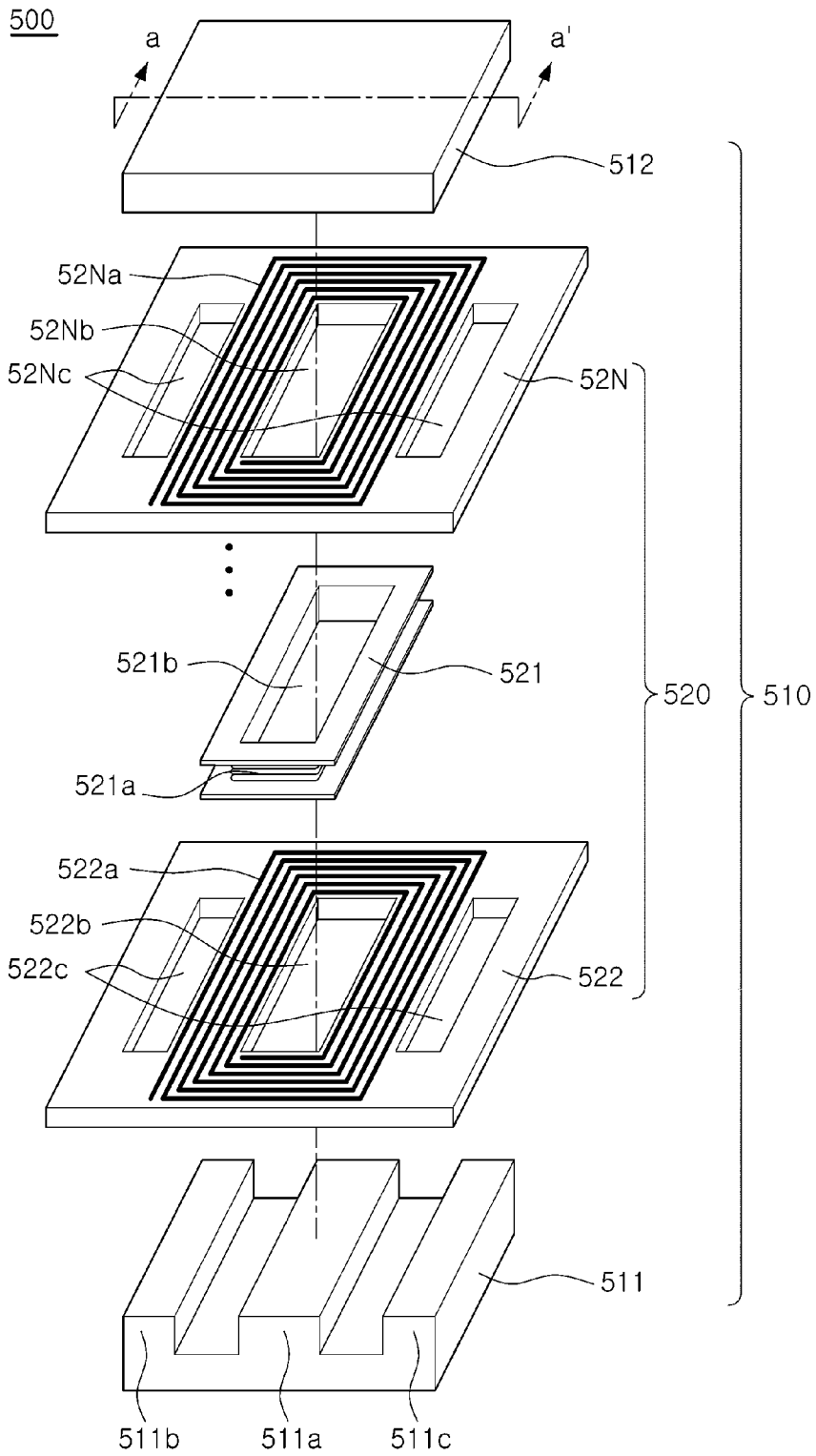
FIG. 7 is an exploded perspective view of a fifth exemplary embodiment of the present invention.
Figure 8:
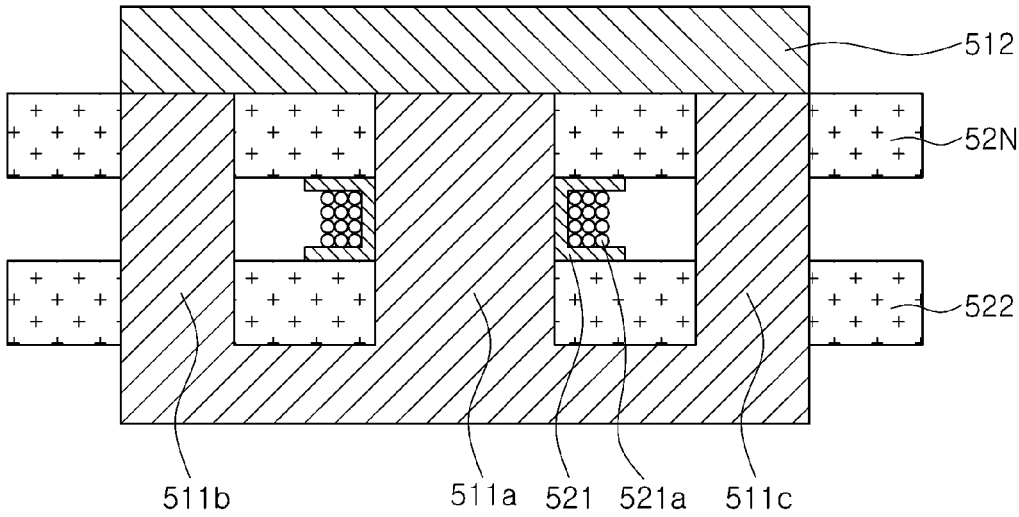
FIG. 8 is a cross-sectional view taken along line a-a' of the fifth exemplary embodiment depicted in FIG. 7.

FIG. 7 is an exploded perspective view of a fifth exemplary embodiment of the present invention, and FIG. 8 is a cross-sectional view taken along line a-a' of FIG. 7.

According to the fifth exemplary embodiment, the stacked order of the plurality of boards and the inner bobbin part in the planar transformer 400 of FIG. 6 may be varied.

As shown in FIGS. 7 and 8, similarly to the planar transformer 400 depicted in FIG. 4, a planar transformer 500 according to this embodiment includes a core unit 510 including a pair of cores 511 and 512 having first to third legs 511*a*, 511*b* and 511*c*, and a bobbin unit 520 including an inner bobbin part 521 having a through hole 521*a*, and a board part including a board 522 having a through hole 522*b* and side through holes 522*c*. A first winding 521*a* is wound around the outer circumferential surface of the bobbin body of the inner bobbin part 521, and a second winding 522*a* is printed on one surface of the board 522.

In addition, the board part may include a plurality of boards 522 to 52N, and the inner bobbin part 521 may be stacked between the plurality of boards 522 to 52N. In FIG. 8, the board part is illustrated as including two boards 522 and 52N. However, the board part may include three or more boards, and the inner bobbin part 521 may be stacked therebetween.

As described above, a plurality of boards are stacked when the second winding needs to have a large number of turns or when multiple outputs are required. In this case, the boards may be stacked on the inner bobbin part 521 or the inner bobbin part 521 may be stacked between the plurality of stacked boards. This may increase a planar transformer's volume to some degree as compared to the planar transformer depicted in FIG. 5. However, considering that a plurality of boards need to be stacked when the number of turns of the first and second windings are satisfied only by stacking boards, the planar transformers 400 and 500 according to the fourth and fifth exemplary embodiments achieve a reduction in height and thus in volume as compared to the related art where a plurality of boards are stacked.

As set forth above, according to exemplary embodiments of the invention, the planar transformer has a dual-bobbin structure in which a primary side with a greater number of turns is wound around the outer circumferential surface of an inner core and a secondary side with a smaller number of turns is printed on a board. Accordingly, the planar transformer can achieve slimness with low manufacturing costs, facilitate the manufacturing process thereof, easily ensure an insulating distance between the primary side and the secondary side of the transformer, and easily attain uniform leakage inductance.

While the present invention has been shown and described in connection with the exemplary embodiments, it will be apparent to those skilled in the art that modifications and variations can be made without departing from the spirit and scope of the invention as defined by the appended claims.

What is claimed is:

1. A planar transformer, comprising:

a core unit including a pair of cores that are configured to electromagnetically couple to each other; and a bobbin unit including:

an inner bobbin part including:

a bobbin body having a predetermined volume and having a first through hole into which a portion of the pair of cores is inserted, and a first winding wound around an outer circumferential surface of the bobbin body; and a board part including at least one board including:

a board body having a predetermined surface area and having a second through hole into which the inner bobbin part and a portion of the pair of cores are inserted, and a second winding formed on at least one surface of the board body, disposed around the second through hole, and configured to electromagnetically interact with the first winding, wherein the first winding is disposed in the second through hole of the at least one board.

2. The planar transformer of claim 1, wherein the at least one board comprises a plurality of boards that are stacked.

3. The planar transformer of claim 1, wherein the first winding has a greater number of turns than the second winding.

4. The planar transformer of claim 1, wherein the pair of cores have first to third legs that are configured to electromagnetically couple to each other.

5. The planar transformer of claim 4, wherein the at least one board further includes a first side through hole and a second side through hole, the first leg is inserted into the first and second through holes, the second leg is inserted into the first side through hole, and the third leg is inserted into the second side through hole.

6. The planar transformer of claim 1, wherein the second winding is farther spaced apart from a center of the second through hole than the first winding.

* * * * *